US006061930A

United States Patent [19]

Zinovieff

[11] Patent Number: 6,061,930

[45] Date of Patent: May 16, 2000

[54] GLIDING SHOE

[75] Inventor: Vladimir Zinovieff, Boulder, Colo.

[73] Assignee: Salomon S.A., Metz-Tessy, France

[21] Appl. No.: 09/199,285

[22] Filed: Nov. 25, 1998

[51] Int. Cl.[7] ..... A43B 5/00; A43B 13/22; A43B 13/24; A43B 13/28

[52] U.S. Cl. ..... 36/115; 36/132; 36/73; 36/103; 36/136; 36/75 R; 36/45; 36/114; 36/107

[58] Field of Search ..... 36/132, 115, 114, 36/107, 72 A, 73, 108, 25 R, 148, 149, 152, 163, 116, 133, 136, 7.1 R, 76 R, 76 C, 72 R, 72 B, 75 R, 75 A, 82, 45

[56] References Cited

U.S. PATENT DOCUMENTS

| | | | |
|---|---|---|---|
| 579,577 | 3/1897 | Hanscom | 36/72 A |
| 702,476 | 6/1902 | Price | 36/72 R |
| 875,560 | 12/1907 | Vaughan | 36/72 R |
| 892,152 | 6/1908 | Harman | 36/72 R |
| 1,056,091 | 3/1913 | Dickson | 36/72 R |
| 1,428,232 | 8/1922 | Holmen | 36/72 R |
| 2,484,935 | 10/1949 | De Rooy | 36/7.7 |
| 4,691,453 | 9/1987 | Tifre | 36/115 |
| 5,249,376 | 10/1993 | Capria | 36/115 |
| 5,388,350 | 2/1995 | Parker, Jr. | 36/115 |
| 5,410,821 | 5/1995 | Hilgendorf | 36/100 |
| 5,682,685 | 11/1997 | Terlizzi | 36/25 R |
| 5,716,723 | 2/1998 | Van Cleef et al. | 36/25 R |

FOREIGN PATENT DOCUMENTS

| | | |
|---|---|---|
| 29613508 | 11/1996 | Germany . |
| WO98/01051 | 1/1998 | WIPO . |
| WO98/03092 | 1/1998 | WIPO . |

*Primary Examiner*—Paul T. Sewell
*Assistant Examiner*—Anthony Stoshick
*Attorney, Agent, or Firm*—Greenblum & Bernstein, P.L.C.

[57] ABSTRACT

A gliding shoe having an upper and a sole in which a sliding zone is obtained. At least one referencing arrangement is obtained on the upper in correspondence with the sliding zone. The referencing arrangement enables the user to use his/her eyes to place the shoe in the position that is best suited to the alignment of the sliding zone with the long support on which he engages to glide.

34 Claims, 3 Drawing Sheets

Fig: 1
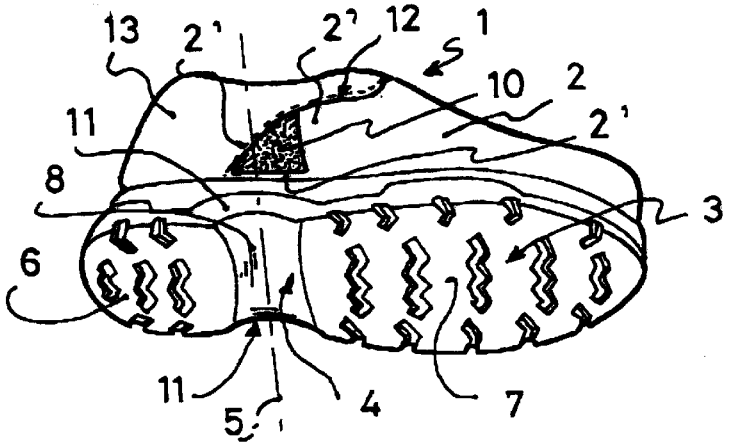
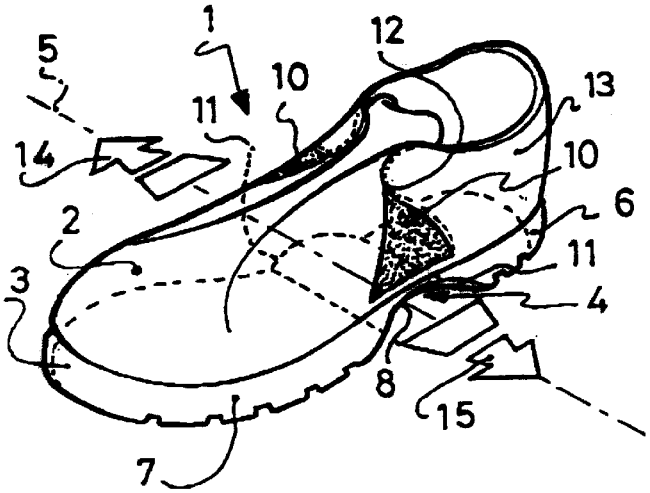
Fig: 2
Fig: 3
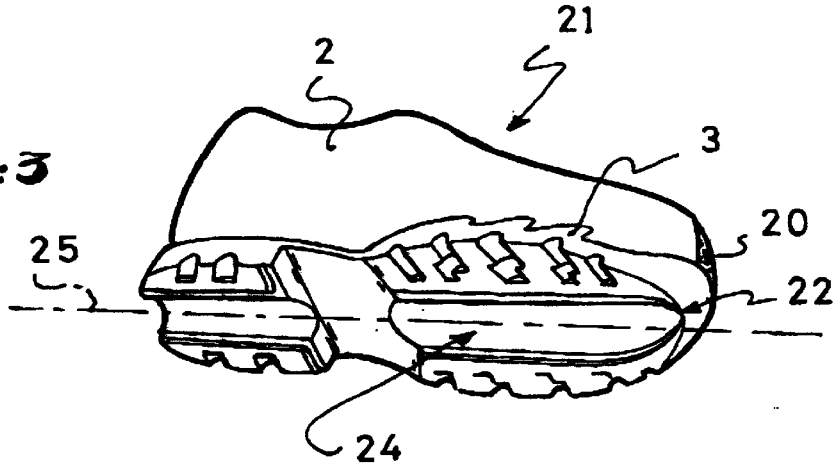

GLIDING SHOE

BACKGROUND OF THE INVENTION

1. Field of the Invention

The present invention relates to a gliding shoe, more commonly called a "grind" shoe, i.e., adapted to allow performing figures by gliding on various long supports, such as stairwell guardrails, rails, wall edges, etc.

2. Description of Background and Material Information

By way of example, one can cite the German Utility Design DE 296 13 508 and published International Patent Applications Nos. WO 98/01051 and WO 98/03092, which describe shoes of the above-mentioned type. These documents disclose shoes in which at least one sliding zone is obtained in the sole and oriented in a direction that is predetermined with respect to the longitudinal axis of the shoe. More specifically, DE 296 13 508 shows an essentially transverse sliding zone, whereas WO 98/01051 and WO 98/03092 show sliding zones that can be longitudinal, transverse, or diagonal. The various orientations of these sliding zones are in fact adapted to enable the shoe user to perform a plurality of gliding figures taking into account the various changes in the shoe position that are involved to make each sliding zone coincide with the direction imposed by the long support, respectively, on which the user engages. Since the sliding zones are located on the sole, and are therefore not visible to the user, the latter has to familiarize himself with these shoes, through use and practice, in order to be capable of aligning the sliding zones correctly with the gliding supports. Of course, the user must acquire a certain movement accuracy, even a kind of automatism specific to each gliding shoe, even if he already has a certain technique and/or experience, because the orientation of the sliding zones often differ from one shoe model to another.

It is obvious that this period for adapting to a gliding shoe model can be relatively short depending on the agility, skill and/or talents of the user; however, it remains true that it is tedious. Moreover, during this period, the user proceeds tentatively and tests various directions to determine the best position(s) for gliding on a long support; consequently, it is almost impossible for him/her not to damage the engaging edges that demarcate the sliding zones and that open on the periphery of the sole because, a priori, nothing enables him/her to position them correctly with respect to the long support on which he/she engages.

SUMMARY OF THE INVENTION

An object of the present invention is to overcome the aforementioned various drawbacks and, in particular, it aims to shorten the time required for adapting to the gliding shoe, on the one hand, and as much as possible, to prevent damaging the engaging edges of the sliding zones that open on the sole periphery.

This object is achieved by providing the wearer of the gliding shoe with at least a referencing means visible on the shoe upper, that is in relation with the engaging edges of the sliding zone(s) obtained in the sole. Indeed, due to this arrangement, the user has a visual reference that enables him to use his eyes to place the shoe in the position that is best suited to the alignment of a sliding zone of the sole with the long support on which he engages to glide.

According to the invention, the gliding shoe, which has an upper and a sole in which is obtained at least one sliding zone oriented in a direction predetermined with respect to the longitudinal axis of the shoe, has at least one referencing element or referencing means is obtained on the upper correspondingly with at least one sliding zone.

According to one characteristic, the referencing element or referencing means is located in correspondence with an engaging edge of the sliding zone that opens on the sole periphery.

According to an embodiment, the referencing element or referencing means has an aspect or appearance which contrasts with the surrounding portions of the upper, and extends on the latter from the level of the sole of the shoe, directly above the engaging edge of the sliding zone obtained in the sole. Preferably, the referencing means is almost in correspondence with the engaging edge of the sliding zone and rises from the sole along the upper in a more or less elongated form calling for a direction going toward the engaging edge of the sliding zone or coming therefrom.

According to alternative embodiments, the referencing element or referencing means has a shape that is completely or at least partially demarcated by yokes covering the shoe upper.

BRIEF DESCRIPTION OF DRAWINGS

The invention will better understood and other characteristics will become apparent in the description that follows, with reference to the attached schematic drawings which illustrate, by way of example, several embodiments in which:

FIGS. 1 and 2 show an embodiment of a shoe according to the invention, with a transverse sliding zone;

FIGS. 3 and 4 show another embodiment of a shoe according to the invention, with a transverse sliding zone.

DETAILED DESCRIPTION OF THE INVENTION

Figure 4:
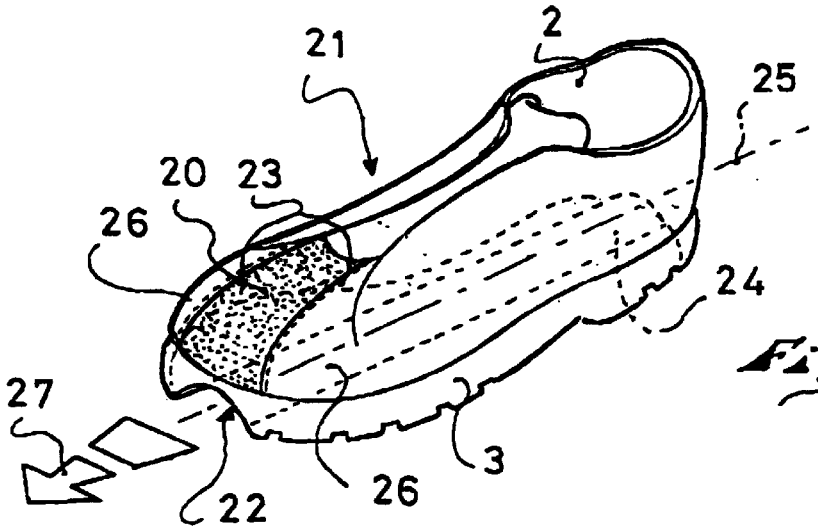

The gliding shoe 1, or "grind" shoe, shown in FIGS. 1 and 2, has an upper 2 and a sole 3 that is provided with a sliding zone 4. In this example, this sliding zone 4 is oriented transversely with respect to the shoe, as indicated by the dotted line 5, and is located substantially plumb with the camber of the latter, i.e., between the heel 6 and the front 7 of the sole 3. In the illustrated embodiment, the sliding zone 4 comprises a concave surface 8. The front 7 and rear 6 of the sole comprise lowermost surfaces, i.e., "walking surfaces", of the sole. As shown in the drawings, the concave surface of the sliding zone 4 is demarcated by a pair of edges with the walking surfaces. According to the invention, a referencing element or referencing means 10 is obtained on the upper 2 of the shoe 1 in relation with each of the engaging edges 11 of the sliding zone 4. Thus, the user of the shoe 1, from a standing position, can accurately locate the sliding zone 4 that is in the sole 3, whether for gliding inwardly or outwardly, as indicated by the arrows 14 and 15. This referencing means 10 has an aspect or appearance that is advantageously provided to contrast with the surrounding portions 2' of the upper 2; in this case, the contrast is obtained by varying colors between the referencing means 10 and these portions 2'. This contrast is further accentuated by the contiguous arrangement of the edge 12 of a yoke 13 covering the heel portion of the upper 2. In order to make this referencing means easily visible to the user from a standing position, it is provided in an elongated shaped which extends on the flank of the upper 2 of the shoe 1 from the level of the sole 3, directly above the engaging edge 11 of the sliding zone 4, and rises in the direction of the top of the upper 2. Advantageously, the referencing means 10 has an elongated shape calling for a direction which, in this case, extends from the engaging edge 11 of the sliding zone 4 toward the top of the upper 2. Of course, the elongated shape of the referencing means 10 can inversely call for a direction that comes from the top of the upper 2 and goes toward the engaging edge 11 of the sliding zone 4.

In the example of FIGS. 3 and 4, the shoe 21 with an upper 2 and a sole 3 differs from the preceding shoe 1 in that the sliding zone 24 is oriented approximately in the longitudinal axis of the shoe 21, as indicated by the dotted line 25. As a result, a referencing element or referencing means 20 is placed at the tip of the shoe, in correspondence with the engaging edge 22 of the sliding zone 24. In this embodiment, the referencing means 20 is demarcated laterally by the edges 23 of the yokes 26 covering the upper 2. As previously described, the elongated referencing means 20 extends on the upper 2 from the level of the sole 3, directly above the engaging edge 22 of the sliding zone 24, and rises toward the top of the upper 2, i.e., in this case, up to the area where the upper 2 of the shoe 21 is closed, for example, by a lacing means, not shown. The user of the shoe 21 thus has a direct view of the referencing means 20 that extends plumb with the sliding zone 24 and can use his eyes to place the shoe 21 in the position that is best suited to the gliding direction, as indicated by the reference numeral 27, and to the alignment of the sliding zone 24 with the long support on which he wishes to engage.

Figure 4A:
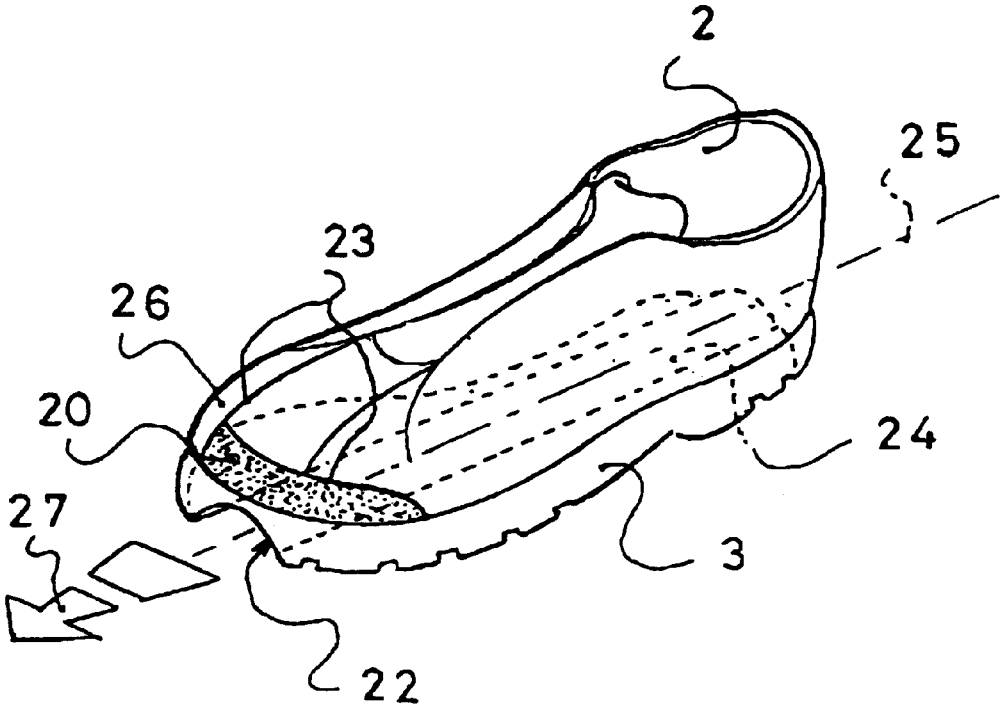
FIG. 4*a* shows a variation of the embodiment shown in FIGS. 3 and 4.

The example shown in FIG. 4*a*, the shoe has a referencing means 20 which is demarcated on one lateral edge 23 only, of the yoke 26, the referencing means 20 extending beyond the lateral edge of the other yoke, thereby giving the referencing means an asymmetrical aspect with respect to the upper 2.

Figure 5:
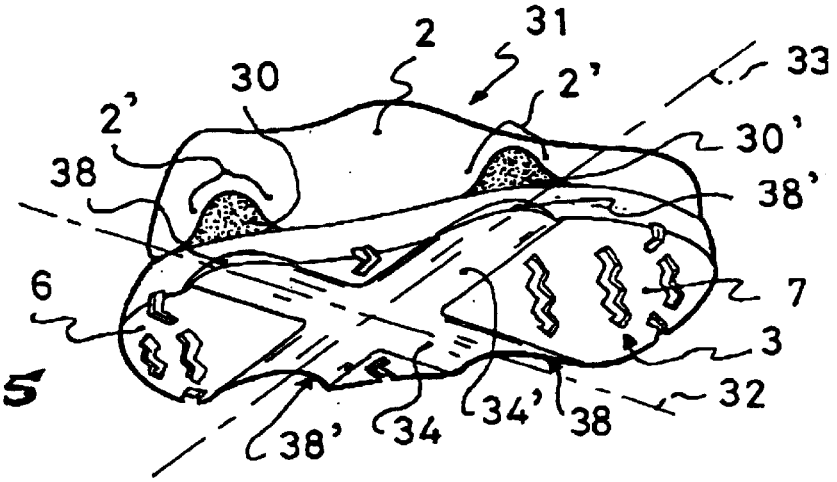
FIGS. 5 and 6 illustrate yet another embodiment of a shoe according to the invention, with two diagonal sliding zones.
Figure 6:
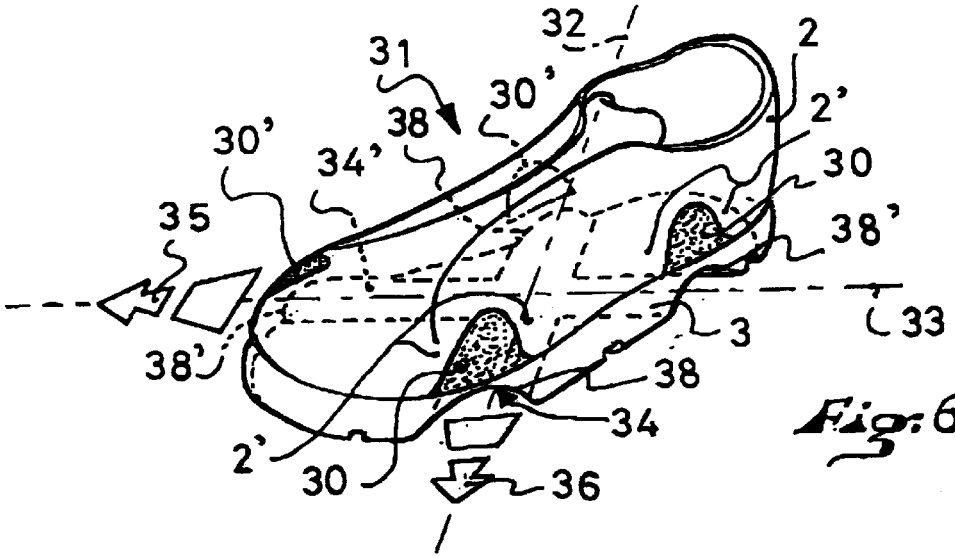

In the example shown in FIGS. 5 and 6, the shoe 31 has two sliding zones 34, 34' arranged diagonally in the sole 3, and which intersect between the front 7 and the heel 6 of the latter. Consequently, the shoe 31 can be used to selectively perform glides along an axis 32 or along an axis 33, as indicated by the arrows 35 and 36. In order to provide aiming possibilities corresponding to these sliding zones 34, 34', referencing elements or referencing means 30, 30' are obtained on the upper 2 of the shoe 31, in the vicinity of the engaging edges 38, 38'. The upper 2 thus has two referencing means 30 or 30' on each of its flanks.

The shoe 1, 21, and/or 31 can be made with sliding zones oriented differently than those 4, 24, 34, and 34' described hereinabove, without leaving the scope of the invention. The sliding zones 4, 24, 34, and 34' can also be combined with one another.

Furthermore, the referencing means 20, 30, 30' can only be obtained on the front of the shoe 21, 31.

Finally, the referencing means 10, 20, 30, 30' can be provided to project or to be recessed with respect to the surrounding portions 2' of the upper 2 in order to accentuate the contrast, in addition to a change in the color or shape, and they can constitute an extension with the same aspect or appearance or shape of the engaging edges 11, 22, 38, 38' of the sliding zones 4, 24, 34, 34'. The referencing means 10, 20, 30, 30' can also contrast with the surrounding portions 2' of the upper 2 due merely to an evident asymmetrical aspect obtained with the covering yokes 13, 26, of the upper 2.

What is claimed is:

1. A sport shoe adapted for gliding, said shoe comprising:

a sole having at least one lowermost walking surface and at least one sliding zone, said sliding zone being oriented in a direction predetermined with respect to the longitudinal axis of the shoe and comprising at least one surface adapted to enable said sole to slide upon and with respect to another surface, said surface of said sliding zone being concave with respect to said lowermost surface of the sole; and an upper affixed to said sole, said upper comprising at least one referencing element having a location on said upper in correspondence with said at least one sliding zone of said sole.

2. A sport shoe according to claim 1, wherein:

said sole has a periphery;

said sliding zone includes at least one engaging edge opening at said periphery of said sole; and said location of said reference element on said upper corresponds with said engaging edge of said sliding zone.

3. A sport shoe according to claim 1, wherein:

said referencing element has an appearance in contrast with surrounding portions of said upper.

4. A sport shoe according to claim 2, wherein:

said referencing element has an appearance in contrast with surrounding portions of said upper.

5. A sport shoe according to claim 2, wherein:

said referencing element extends on said upper from said sole, directly above said engaging edge of said sliding zone.

6. A sport shoe according to claim 4 wherein:

said referencing element extends on said upper from said sole, directly above said engaging edge of said sliding zone.

7. A sport shoe according to claim 2, wherein:

said referencing element is elongated and extends from an upper part of said upper in a direction toward said engaging edge of said sliding zone.

8. A sport shoe according to claim 3, wherein:

said referencing element is elongated and extends from an upper part of said upper in a direction toward said engaging edge of said sliding zone.

9. A sport shoe according to claim 6, wherein:

said referencing element is elongated and extends from an upper part of said upper in a direction toward said engaging edge of said sliding zone.

10. A sport shoe according to claim 2, wherein:

said referencing element is elongated and extends upwardly from said sole.

11. A sport shoe according to claim 3, wherein:

said referencing element is elongated and extends upwardly from said sole.

12. A sport shoe according to claim 6, wherein:

said referencing element is elongated and extends upwardly from said sole.

13. A sport shoe according to claim 1, further comprising:

yokes positioned over portions of said upper; and wherein said referencing element has a shape at least partially demarcated by at least one of said yokes.

14. A sport shoe according to claim 1, wherein:

said sliding zone extends along said longitudinal axis.

15. A sport shoe according to claim 1, wherein:

said sliding zone extends in a direction transverse to said longitudinal axis.

16. A sport shoe according to claim 15, wherein:

said sliding zone extends substantially perpendicularly with respect to said longitudinal axis.

17. A sport shoe according to claim 1, wherein:

said at least one sliding zone comprises two intersecting sliding zones.

18. A sport shoe according to claim 1, wherein:

said referencing element is part of said upper.

19. A sport shoe according to claim 1, wherein:

said referencing element is located on a front end portion of said upper.

20. A sport shoe adapted for gliding, said shoe comprising:

a sole having at least one lowermost walking surface and at least one sliding zone, said sliding zone being oriented in a direction predetermined with respect to the longitudinal axis of the shoe and comprising at least one surface adapted to enable said sole to slide upon and with respect to another surface, said surface of said sliding zone being concave with respect to said lowermost surface of the sole; and an upper affixed to said sole, said upper comprising at least one referencing means located on the upper in correspondence with said at least one sliding zone of said sole.

21. A sport shoe adapted for gliding, said shoe comprising:

a sole having lowermost walking surfaces and at least one sliding zone, said sliding zone being oriented in a direction predetermined with respect to the longitudinal axis of the shoe and comprising at least one surface recessed with respect to said lowermost surfaces of the sole, said surface of said sliding zone being adapted to enable said sole to slide upon and with respect to another surface; and an upper affixed to said sole, said upper comprising at least one referencing element located on the upper in correspondence with said at least one sliding zone of said sole.

22. A sport shoe according to claim 21, wherein:

said surface of said sliding zone is concave with respect to said lowermost surfaces of said sole.

23. A sport shoe according to claim 22, wherein:

said lowermost walking surfaces comprise at least one walking surface at a front portion of said sole and at least one walking surface at a rear portion of said sole.

24. A sport shoe according to claim 23, wherein:

said sole has a periphery;

said sliding zone includes at least one engaging edge opening at said periphery of said sole; and said location of said reference element on said upper corresponds with said engaging edge of said sliding zone.

25. A sport shoe according to claim 24, wherein:

said sole has a periphery;

said sliding zone includes at least two engaging edges opening at different locations of said periphery of said sole; and said location of said reference element on said upper corresponds with said engaging edge of said sliding zone.

26. A sport shoe according to claim 25, wherein:

said two engaging edges are located at opposite ends of said sole.

27. A sport shoe according to claim 25, wherein:

said two engaging edges are located at opposite sides of said sole.

28. A sport shoe according to claim 25, wherein:

said two engaging edges are located at a common side of said sole.

29. A sport shoe according to claim 28, wherein:

said at least one sliding zone comprises two intersecting sliding zones, each of said sliding zones extending to a respective one of said two engaging edges.

30. A sport shoe according to claim 21, wherein:

said at least one surface is unitary with said sole.

31. A sport shoe according to claim 30, wherein:

said surface of said sliding zone is demarcated by a pair of spaced apart edges, each of said edges joining said lowermost walking surfaces of said sole.

32. A sport shoe according to claim 21, wherein:

said referencing element has an appearance in contrast with immediately adjacent portions of said upper.

33. A sport shoe according to claim 32, wherein:

said referencing element has a color different from a color of said immediately adjacent portions of said upper.

34. A sport shoe according to claim 21, wherein:

said referencing element is part of said upper.

* * * * *